US005527049A

United States Patent [19]

Ortiz

[11] Patent Number: 5,527,049

[45] Date of Patent: Jun. 18, 1996

[54] DIGGER FOR IN-LINE ROLLER SKATE

[76] Inventor: Juan C. Ortiz, 26691 Paseo Loreto, San Juan Capistrano, Calif. 92675

[21] Appl. No.: 398,438

[22] Filed: Mar. 3, 1995

[51] Int. Cl.[6] ..... A63C 17/14

[52] U.S. Cl. ..... 280/11.2; 188/5; 280/811

[58] Field of Search ..... 280/11.19, 11.2, 280/11.22, 809, 811; 188/5

[56] References Cited

U.S. PATENT DOCUMENTS

| | | | |
|---|---|---|---|
| 2,048,916 | 7/1936 | Bentzlin | 280/11.2 |
| 2,269,362 | 1/1942 | Daniska | 280/11.2 X |
| 2,566,747 | 9/1951 | Rice | 280/11.2 |
| 2,595,751 | 5/1952 | Balstad | 280/11.2 X |
| 2,631,861 | 3/1953 | Daniska | 280/11.2 X |
| 3,104,887 | 9/1963 | Rice et al. | 280/11.2 |
| 4,314,707 | 2/1982 | Welch | 280/811 X |
| 5,068,956 | 12/1991 | Malewicz | 280/11.27 X |

*Primary Examiner*—Mitchell J. Hill
*Assistant Examiner*—Michael Mar
*Attorney, Agent, or Firm*—Donald E. Stout

[57] ABSTRACT

A stabilizing or digger accessory for in-line skates is provided which is adapted to assist roller hockey goaltenders by permitting them to stabilize themselves in a stationary position in goal so that they may react laterally to incoming shots on goal. The digger accessory is easily installed and removed, replacing the frontmost wheel of the skate, so that it may be utilized while the skater is tending goal but removed when he or she wishes to skate normally. Furthermore, even when installed, because of its configuration and orientation with respect to the remaining wheels, the goaltender may skate normally with only a slight change of skating style, so that he or she may easily perform those goaltending duties which require mobility. Essentially, the digger accessory comprises a molded rubber insert wherein the bottom surface consists of a tread. When the heel of the skate is lifted, the tread contacts the skating surface to prevent rolling of the skate.

14 Claims, 2 Drawing Sheets

DIGGER FOR IN-LINE ROLLER SKATE

BACKGROUND OF THE INVENTION

This invention relates generally to accessories for in-line roller skates, and more particularly to digger assemblies adaptable for attachment to in-line roller skates so that skaters may stand up on their toes without losing their balance or rolling out of a desired stationary position.

In-line roller skates have a plurality of wheels mounted for rotation in a common plane on a frame that is attached to a boot. Became of the arrangement of the wheels along a single axis, rather than the paired wheel arrangement on conventional roller skates, in-line roller skating more closely simulates ice skating than does conventional roller skating, having a capability for increased speed and maneuverability. It has consequently become a hugely popular sport and has spawned many associated recreational activities. One such activity is roller hockey. Roller hockey is played in a similar fashion to ice hockey, with each team having a plurality of offensive and defensive skaters, as well as a goaltender to defend the team's goal. The object, as in ice hockey, is to win the game by scoring more goals than the opposing team.

Presently, roller hockey is played at all levels of competition, from the pick-up level where it is played on neighborhood streets ("street hockey"), to organized city and county leagues. It is even now played at a professional level, typically on an indoor rink which closely resembles an ice hockey rink without the ice surface.

Many equipment accommodations have been made to account for the different playing surface utilized in roller hockey with respect to ice hockey, essentially compensating for the fact that a concrete or asphalt surface is harder and less forgiving, and has a much higher coefficient of friction, thereby inhibiting sliding. For example, the puck used in roller hockey typically includes ball bearings, so that it slides in a nearly frictionless fashion across the playing surface. However, one big difference between the two sports is that in ice hockey, the goaltender has greater control and stability in goal, because he is able to slide laterally, and his skates are often equipped with "diggers", comprising small teeth, at the tip of the blade, which grip the ice so that he may get up on his toes and stabilize himself in a stationary position, in preparation for a shot on goal by the opposing team. Thus, the goaltender is able to stop a high percentage of goal attempts. On the other hand, roller hockey goaltenders have no such ability to move laterally, and find it difficult to stabilize themselves in preparation for oncoming goal attempts. Consequently, roller hockey games are usually relatively high scoring compared to ice hockey games.

What is needed, therefore, is a means for providing roller hockey goaltenders with a way to stabilize themselves and react laterally in goal, so that they may perform at a higher level, thereby improving the quality and excitement of the game.

SUMMARY OF INVENTION

The invention provides a stabilizing accessory for in-line roller skates, referred to herein as a "digger", which solves the problems discussed above by permitting roller hockey goaltenders to stabilize themselves in a stationary position so that they may react laterally to incoming shots on goal. The digger accessory is easily installed and removed, replacing the front wheel of the skate, so that it may be utilized while the skater is tending goal but removed when he or she wishes to skate normally. Furthermore, even when installed, because of its configuration and orientation with respect to the remaining wheels, the goaltender may skate normally with only a slight change in skating style, thus enabling him or her to easily perform those goaltending duties which require mobility.

More particularly, a stabilizing accessory for an in-line roller skate having a plurality of wheels ganged along a single axis is provided, wherein the accessory is adapted to replace a frontmost one of the wheels and is further adapted to contact and grip a skating surface when the heel of the skate are lifted upwardly by a wearer of the skate. The contact of the digger accessory with the skating surface, typically concrete or asphalt, advantageously functions to prevent rolling of the skate to thereby stabilize the wearer in a substantially stationary position on the skating surface. Thus, the wearer is positioned to respond effectively to a shot on goal. When it is desired to regain mobility, the heel of the skate need only be lowered so that the digger accessory no longer contacts the skating surface. The stabilizing accessory is attached to the frame of the skate using the same or an identical mechanical fastener as that used to attach the frontmost wheel under ordinary skating conditions.

In another aspect of the invention, an in-line roller skate is provided which comprises a boot having a toe and a heel and a frame having a pair of substantially parallel frame rail members, each of which include a plurality of axially aligned fastener holes. A plurality of wheels, including at least a frontmost wheel and a rearmost wheel, each of which include a fastener hole extending therethrough are ganged axially along the frame and are rotatably mounted to the frame by means of a mechanical fastener, typically an axle bolt and nut, which extends through both the fastener hole in the wheel and corresponding fastener holes in the frame rail members, so that an upper portion of each wheel is located between the frame rail members. A stabilizing accessory is mounted to the frame in axial alignment with the plurality of wheels and forwardly of the frontmost wheel. The accessory, sometimes referred to as a "digger", also has a fastener hole extending therethrough and is mounted to the frame by means of the same type of mechanical fastener which is used to attach the wheels, so that a substantial portion of the accessory is located between the two frame rail members. The stabilizing accessory has a gripping surface on the bottom thereof, and is adapted to contact the skating surface with at least a portion of the gripping surface when the heel of the skate are lifted upwardly by a wearer of the skate. The contact of the gripping surface functions to prevent rolling of the skate to thereby stabilize the wearer in a substantially stationary position on the skating surface. Advantageously, the stabilizing accessory may be replaced by another wheel for ordinary skating purposes.

In yet another aspect of the invention, a method for using a stabilizing accessory for an in-line roller skate is disclosed. The method includes the steps of removing the mechanical fastener securing the frontmost wheel to the frame of the skate, and then removing the wheel from the frame. Then, an aft portion of the stabilizing accessory is located so that it occupies the location formerly occupied by the frontmost wheel, with a fastener hole in the aft portion being aligned with corresponding aligned fastener holes in the frame rail members of the skate. Following this, a mechanical fastener (preferably the same one or a similar one to that used to secure the wheel) is inserted through the aligned fastener holes and secured so that the accessory is mounted to the frame, with a substantial portion of the aft portion of the accessory being located between the frame rail members and a fore portion being arranged to curve and wrap around at least a portion of the toe of the skate. At this juncture, the skate is ready for use. A goaltender uses the skate equipped with the digger accessory by placing it on his or her foot and lifting his heel so that a bottom tread surface of the accessory contacts the skating surface, thereby stopping the rolling motion of the skate and permitting the goaltender to stand upwardly on his toes in a stable and stationary position.

When the goaltender is through playing the game, he or she may remove the accessory by simply reversing the steps outlined above, replacing the accessory once again with the frontmost wheel previously removed.

The invention, together with additional features and advantages thereof, may best be understood by reference to the following description taken in conjunction with the accompanying illustrative drawing.

DETAILED DESCRIPTION OF THE PREFERRED EMBODIMENT

Figure 1:
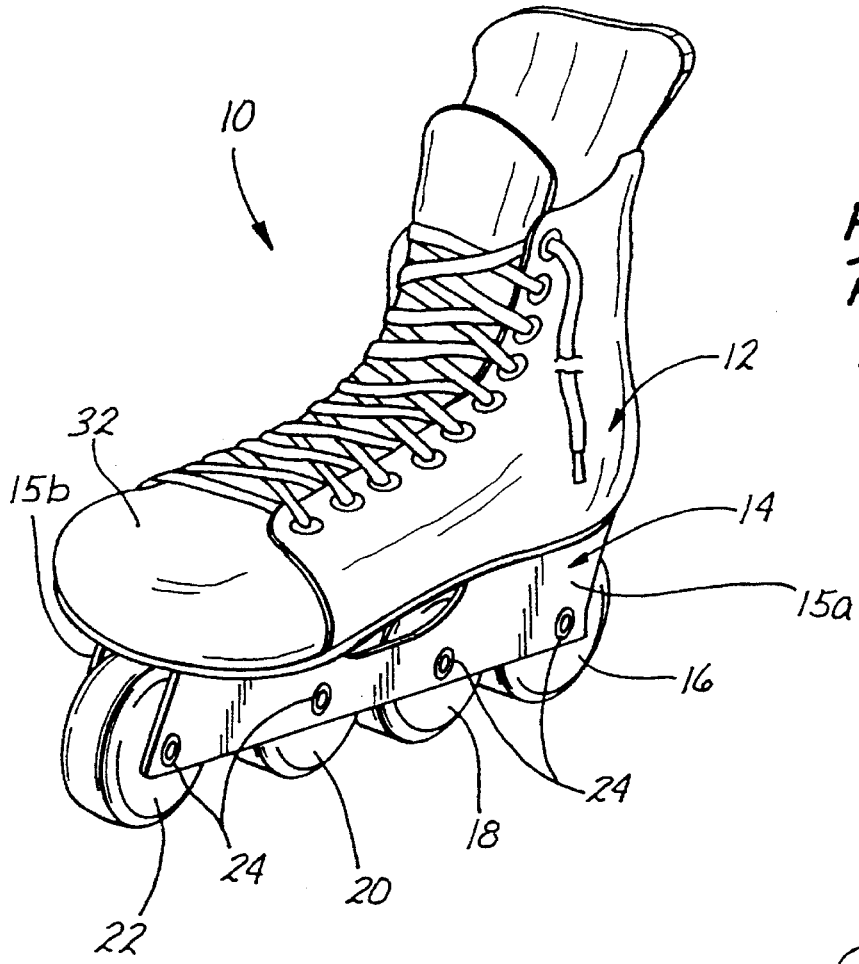
Fig. 1 PRIOR ART
FIG. 1 is a perspective view of a conventional in-line roller skate.

Referring now more particularly to the drawing, FIG. 1 illustrates a conventional in-line roller skate 10 of typical construction, including a boot 12 attached to a frame 14 having a pair of parallel rail members 15*a* and 15*b*, that rotatably supports a plurality of wheels 16, 18, 20, and 22. While four wheels are illustrated, it is well known in the art to employ more or less than four wheels. Each wheel 16, 18, 20, and 22 is removably and rotatably attached to the frame 14 by fasteners 24 so that the upper portion of the wheel is located between the two frame rails 15*a* and 15*b*. Typically, the fasteners 24 comprise mechanical fasteners such as conventional threaded axle bolts and mating nuts, so that the wheels may be readily removed using a wrench in order to replace one or more of the wheels, which wear out relatively frequently. However, other fastening systems may be used as well, such as the system described in U.S. Pat. No. 5,068,956 to Malewicz.

Figure 2:
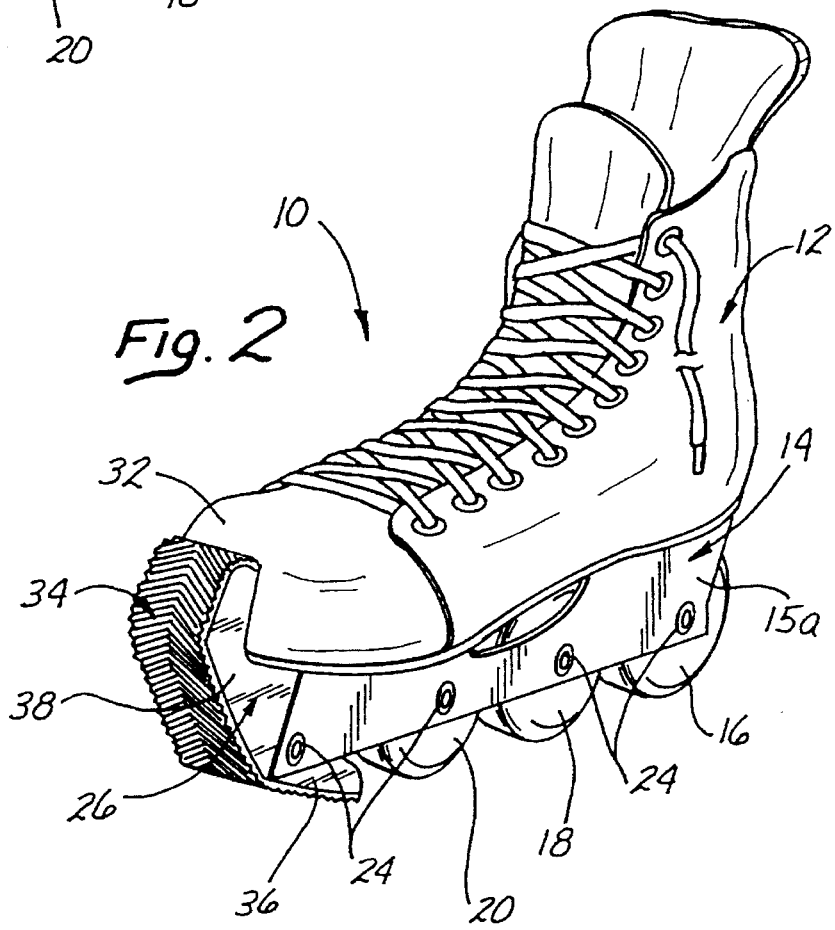
FIG. 2 is a perspective view, similar to FIG. 1, of an in-line skate, wherein the front wheel has been removed and replaced by a digger accessory as shown and described in the present invention.
Figure 3:
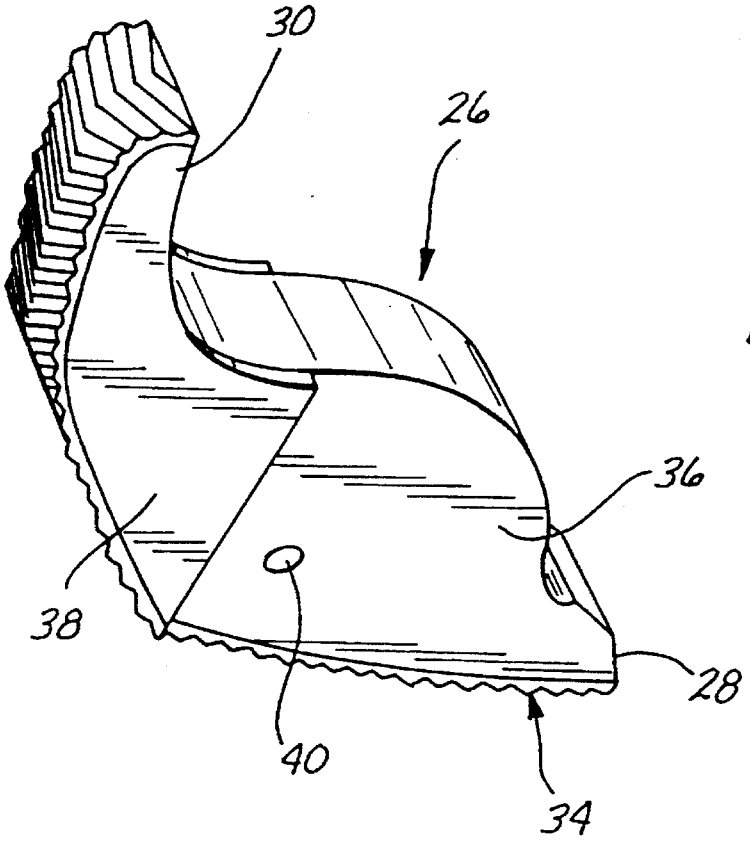
FIG. 3 is a perspective view illustrating the inventive digger accessory.
Figure 4:
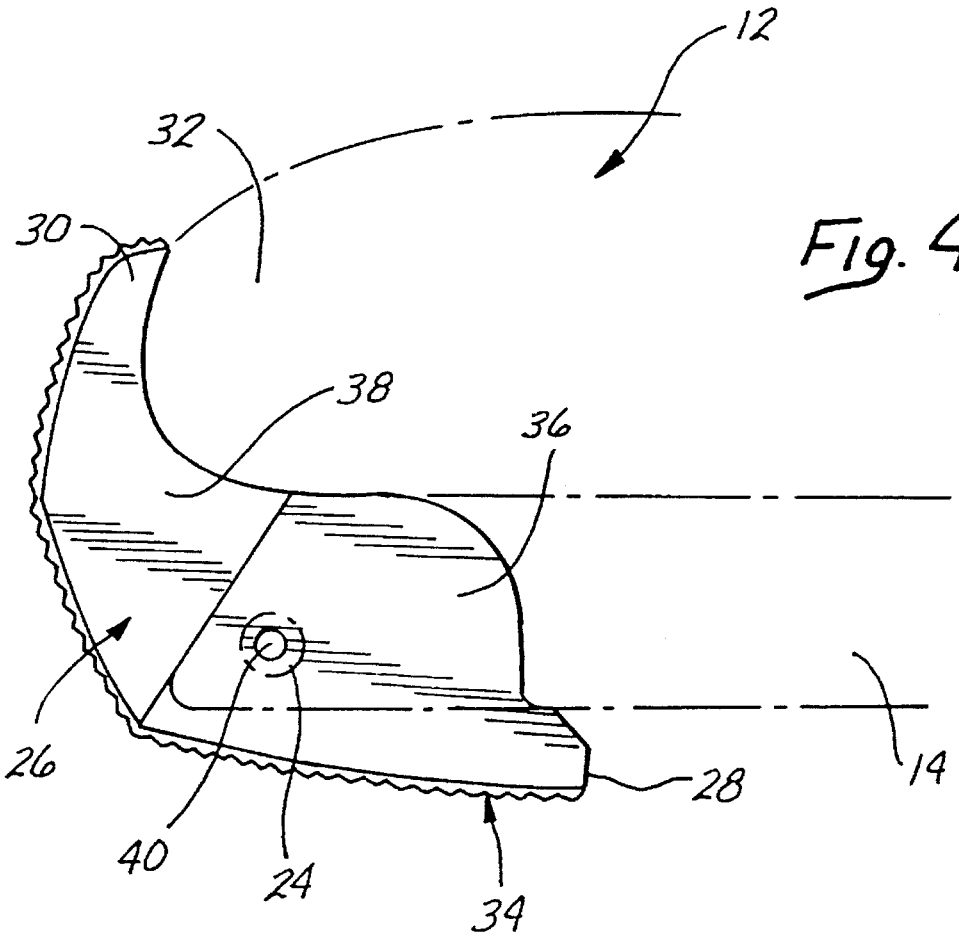
FIG. 4 is a side view of the inventive digger accessory installed on a skate, where only the outline of the skate has been shown, in phantom, for purposes of clarity.

Now with reference to FIG. 2, the skate 10 of FIG. 1 is illustrated wherein the only change is that the inventive digger accessory 26 has been substituted for the front wheel 22. As shown in FIGS. 2–4, the digger assembly 26 is preferably fabricated of molded synthetic rubber which slants upwardly from the rear end 28 to the front end 30, much like the toe of a snow ski, so that when installed, the digger extends upwardly, wrapping around the toe 32 of the skate boot 12. Along the entire bottom surface of the digger 26 is a textured tread 34, comprising any desired design of alternating raised and recessed surfaces, so that better gripping of the skating surface may be obtained. Preferably, the bottom surface along an aft region 36 of the digger is substantially flat, so that it may conform with the flat skating surface, while the bottom surface along a fore region 38 of the digger is curved in conformity with the curvature of the remaining portion of the fore region 38, which in turn is curved in conformity with the toe 32 of the boot 12 so that it is closely wrapped therearound. The width of the tread. 34 is preferably approximately the same as that of a skate wheel, which in the preferred embodiment is approximately 1⅛ inches, though it may vary somewhat along its length from the rear end 28 to the front end 30.

As illustrated, the aft region 36 has a smaller width than the fore region 38, for the purpose of providing a better fitting relationship within the two flame rails 15*a* and 15*b* of the skate when the digger is installed, as illustrated in FIG. 2. However, various configurations fall within the scope of the invention, including the implementation of a substantially constant width along the entire length of the digger. Also, it is presently preferred that the entire digger be injection molded as a single-piece construction, though again various conventional fabrication techniques may be alternatively employed. For example, the digger may be fabricated by cutting and shaping whole block material, or it may be fabricated of a plurality of bonded pieces.

When it is desired to utilize the inventive digger accessory 26, the front wheel 22 (FIG. 1 ) of the skate 10 is removed by conventionally removing the fastener 24. Then, the digger 26 is installed in place of the front wheel 22, as illustrated in FIGS. 2 and 4, so that the fore region 38 of the digger envelops the toe 32 of the boot 12 and much of the aft region 36 of the digger is located between the frame rails 15*a* and 15*b*. A fastener hole 40 is provided in the aft region 36 of the digger (FIGS. 3 and 4), which must be aligned with similar fastener holes in the surrounding frame 14. Once these holes are aligned, proper positioning of the digger is ensured. Then, the fastener 24 is preferably reinserted through the fastener holes in the frame 14 and the fastener hole 40 in the digger 26 so that it extends completely through both the frame and the digger, following which it is secured by a nut or the like in a conventional manner. It is, of course, within the scope of the invention to me a different mechanical fastener, or even a different type of mechanical fastener, to secure the digger accessory, but it is most convenient to use the same one to eliminate the problem of having to keep and store a second fastener with the skate accessory.

Thus, installation of the digger 26 is a simple and quick process, being no more difficult than the routine process of replacing a skate wheel. Consequently, it is possible for a roller hockey goaltender to utilize his or her skates with all wheels installed for normal skating activities, then, in a matter of a few minutes prepare each skate for goaltending duties by removing the front wheel 22 of each and replacing it with a digger 26. Then, when the game is concluded, the skates may be re-convened to ordinary skates by reversing the process; i.e. removing the fastener 24 securing the digger to the frame 14, removing the digger, re-installing the front wheel 22, and then inserting the fastener 24 through the fastener holes in the frame 14 and the wheel 22 and securing it by means of a nut or the like, as previously described.

While installed, goaltenders wearing digger-equipped skates may utilize the diggers by raising the heel of each skate while standing in a stationary position, thus raising themselves up on their toes. In this position, the tread 34 of the digger is in contact with the skating surface, gripping the surface sufficiently to stop the skate's rolling motion. Therefore, the goaltender is in a stabilized stationary position, and can react more controllably to incoming shots on goal by the opposing team. With practice, the goaltender can even move and react laterally, as an ice hockey goaltender does, by "walking" in a sideways fashion while remaining on his toes, such that the tread 34 of each digger remains in contact with the skating surface. Typically, goaltenders will raise themselves up on their toes a sufficient amount so that the flat portion of the tread 34 coinciding with the aft region 36 of the digger contacts the skating surface, though if they raise themselves up even higher the bottom surface of the tread coinciding with the digger fore region 38 will still contact the skating surface and provide the aforementioned advantages.

It should be noted that, because the tread 34 does not contact the skating surface when the goaltender's heel is not raised; i.e. when the skate is in a normal skating position, it is possible to skate normally around the skating surface on the remaining wheels with only a slight adjustment in skating style. However, the inventive accessory is primarily designed for goaltending purposes only, and is generally not used for other skating purposes. When it is desired to skate conventionally, the digger accessory 26 is removed by reversing the steps outlined above, i.e. by removing the forward fastener 24, removing the digger, installing the front wheel 22, then re-installing and securing the fastener 24.

While this invention has been described with respect to various specific examples and embodiments, it is to be understood that the invention is not limited thereto and that it can be variously practiced within the scope of the following claims.

What is claimed is:

1. An in-line roller skate for skating on a skating surface, comprising:

a boot having a toe and a heel;

a frame having a pair of substantially parallel frame rail members, each of which include a plurality of axially aligned fastener holes;

a plurality of wheels, including at least a forwardmost wheel and a rearmost wheel, each of which have a fastener hole extending therethrough and being arranged axially along said frame, each of said wheels being rotatably mounted to said frame by means of a mechanical fastener extending through both the fastener hole in the wheel and corresponding fastener holes in said frame rail members, so that an upper portion of each said wheel is located between said frame rail members;

a stabilizing accessory being mounted to said frame in axial alignment with said plurality of wheels and at a location normally occupied by the forwardmost wheel, said accessory having a fastener hole extending therethrough and being mounted to the frame by means of a mechanical fastener of the same general type as is used to attach the wheels to the frame members, said fastener member extending through both the fastener hole in the accessory and corresponding fastener holes for normally securing the forwardmost wheel in each said frame rail member, so that a substantial portion of said accessory is located between the two frame rail members;

said stabilizing accessory having a gripping surface on the bottom thereof, and being adapted to contact the skating surface with at least a portion of the gripping surface when the heel of said skate is lifted upwardly by a wearer of the skate, the contact of the gripping surface and the skating surface functioning to prevent rolling of the skate to thereby stablize the wearer in a substantially stationary position on the skating surface, said stabilizing accessory further comprising a lower portion and an upper portion, the lower portion including said fastener hole and being adapted for positioning between said two frame rail members, and the upper portion being configured to extend upwardly to generally conform to the shape of the toe.

2. An in-line roller skate as recited in claim 1, wherein the stabilizing accessory is adapted to be replaced by the forwardmost wheel for ordinary skating purposes.

3. An in-line roller skate as recited in claim 1, wherein the stabilizing accessory is mounted to the frame using an identical mechanical fastener to that used to mount the wheels to the frame and in an identical manner.

4. An in-line roller skate as recited in claim 2, wherein the same fastener used to mount the accessory to the frame is used to mount the forwardmost wheel to the frame.

5. An in-line roller skate as recited in claim 1, wherein the stabilizing accessory comprises molded rubber.

6. An in-line roller skate as recited in claim 1, wherein the gripping surface comprises a textured tread.

7. An in-line roller skate as recited in claim 6, wherein the textured tread includes a first portion which is substantially flat, for conforming with the substantially flat skating surface, and a second portion which is curved upwardly to generally conform with the toe of said skate.

8. An in-line roller skate as recited in claim 1, wherein the width of the accessory is approximately equal to the width of one of said skate wheels.

9. A method of using a stabilizing accessory for an in-line roller skate which comprises a boot having a toe and a heel, a frame having a pair of substantially parallel frame rail members, each of which include a plurality of axially aligned fastener holes, and a plurality of wheels including at least a frontmost wheel and a rearmost wheel, each of the wheels being rotatably mounted to said frame by means of a mechanical fastener extending through aligned ones of said frame rail member fastener holes and a fastener hole in the wheel, the method comprising;

a) removing the mechanical fastener securing the frontmost wheel to the frame and then removing the wheel from the frame;

b) positioning an aft portion of the stabilizing accessory so that it occupies the location formerly occupied by said frontmost wheel, with a fastener hole in said aft portion being aligned with corresponding aligned fastener holes in said frame rail members normally used for attaching the frontmost wheel to the frame; and c) inserting a mechanical fastener through said aligned fastener holes and securing the accessory so as to be mounted to the frame, with a substantial portion of the aft portion being located between the frame rail members and a fore portion being arranged to extend upwardly and wrap around at least a portion of the toe of the skate.

10. The method as recited in claim 9 and further comprising the steps of:

d) placing said skate on the foot of a roller hockey goaltender; and e) lifting the heel of said goaltender so that a bottom tread surface of said accessory contacts the skating surface, thereby stopping the rolling motion of said skate and permitting the goaltender to stand upwardly on his toes in a stable and stationary position.

11. The method as recited in claim 10, and further comprising the steps of:

f) removing the mechanical fastener securing the accessory to the frame and then removing the accessory from the frame;

g) locating said removed frontmost wheel in the location formerly occupied by said stabilizing accessory, with the fastener hole in said wheel being aligned with corresponding aligned fastener holes in said frame rail members; and h) inserting a mechanical fastener through said aligned fastener holes and securing it so that the wheel is rotatably mounted to the frame, with an upper portion of the wheel being located between the frame rail members.

12. A stabilizer accessory for attachment to an in-line roller skate for skating on a skating surface, the skate including a boot having a toe and a heel, a frame having a pair of substantially parallel frame rail members, each of which include a plurality of axially aligned fastener holes, a plurality of wheels, including at least a forwardmost wheel and a rearmost wheel, each of which have a fastener hole extending therethrough and being arranged axially along said frame, each of said wheels being rotatably mounted to said frame by means of a mechanical fastener extending through both the fastener hole in the wheel and corresponding fastener holes in said frame rail members, so that an upper portion of each said wheel is located between said frame rail members, wherein:

the stabilizing accessory is adapted to be mounted to said frame in axial alignment with said plurality of wheels and at a location normally occupied by the forwardmost wheel, said accessory having a fastener hole extending therethrough and being adapted to be mounted to the frame by means of a mechanical fastener of a generally similar type as those used to attach the wheels to the frame, said fastener extending through both the fastener hole in the accessory and corresponding fastener holes for normally securing the forwardmost wheel in each said frame rail member, so that a substantial portion of said accessory is located between the two frame rail members, said stabilizing accessory having a gripping surface on the bottom thereof, and being adapted to contact the skating surface with at least a portion of the gripping surface when the heel of said skate is lifted upwardly by a wearer of the skate, the contact of the gripping surface and the skating surface functioning to prevent rolling of the skate to thereby stabilize the wearer in a substantially stationary position on the skating surface, the stabilizing accessory including a lower portion with said fastener hole extending therethrough and an upper portion extending upwardly to wrap about at least a portion of the toe.

13. A stabilizing accessory as recited in claim 12, wherein the width of the accessory is approximately 1⅛ inches.

14. A stabilizing accessory as recited in claim 12, wherein the stabilizing accessory further comprises a midportion and the lower portion has a substantially fiat gripping surface.

* * * * *